US008181420B2

(12) United States Patent
Torrents I Comas

(10) Patent No.: US 8,181,420 B2
(45) Date of Patent: May 22, 2012

(54) LEVELLING DEVICE FOR THE PLACING OF PIECES FOR COVERING FLOORS AND SIMILAR

(75) Inventor: Josep Torrents I Comas, Barcelona (ES)

(73) Assignee: Germans Boada, S.A. (ES)

( * ) Notice: Subject to any disclaimer, the term of this patent is extended or adjusted under 35 U.S.C. 154(b) by 0 days.

(21) Appl. No.: 12/727,550

(22) Filed: Mar. 19, 2010

(65) Prior Publication Data

US 2010/0263304 A1 Oct. 21, 2010

(30) Foreign Application Priority Data

Apr. 17, 2009 (ES) ..... 200930036

(51) Int. Cl.
*E04F 21/18* (2006.01)

(52) U.S. Cl. ..... 52/749.11; 52/127.7

(58) Field of Classification Search ..... 52/127.7, 52/98, 100, 389, 384, 385, 388, 749.1, 749.11, 52/749.15

See application file for complete search history.

(56) References Cited

U.S. PATENT DOCUMENTS 2,080,190 A * 5/1937 Sinner ..... 52/698
2,769,212 A * 11/1956 Hammitt et al. ..... 52/750
4,397,125 A * 8/1983 Gussler, Jr. ..... 52/127.3
5,269,114 A * 12/1993 Albers et al. ..... 52/698
5,535,566 A * 7/1996 Wilson et al. ..... 52/506.07
5,623,799 A * 4/1997 Kowalski et al. ..... 52/392
5,675,942 A * 10/1997 Crawford ..... 52/127.3
6,245,415 B1 * 6/2001 Keller et al. ..... 428/188
6,739,673 B2 * 5/2004 Gupta et al. ..... 297/452.65
7,128,373 B2 * 10/2006 Kurtycz et al. ..... 297/452.15
7,240,460 B2 * 7/2007 Platt ..... 52/506.07
7,257,926 B1 * 8/2007 Kirby et al. ..... 52/126.5
7,603,825 B2 * 10/2009 Dohren ..... 52/478
7,621,100 B2 * 11/2009 Kufner et al. ..... 52/749.11
7,779,593 B2 * 8/2010 Jahn et al. ..... 52/506.06
2001/0020350 A1 * 9/2001 Gorman ..... 52/210
2005/0260385 A1 * 11/2005 Cowelchuk et al. ..... 428/138
2005/0269837 A1 * 12/2005 Carroll et al. ..... 296/187.03
2006/0185269 A1 8/2006 Kufner et al.
2006/0185319 A1 * 8/2006 Kufner et al. ..... 52/749.11
2008/0236094 A1 * 10/2008 Doda ..... 52/749.11

* cited by examiner

*Primary Examiner* — Eileen D Lillis
*Assistant Examiner* — Alp Akbasli
(74) *Attorney, Agent, or Firm* — Ostrolenk Faber LLP

(57) ABSTRACT

The device has a first lower substantially flat body, which has in its upper part a flexible post with a narrowed or weakened portion and a second upper body with the passage for receiving and securing said post. The flexible post, which has a rectangular cross section, has in its main surfaces respective mutually opposed toothings, which teeth are offset in the lengthwise direction and the passage of the second body has two latching pawls mutually opposed, so that in the operative position of the devices, the teeth of the flexible post engage in an alternate form with said latching pawls. The second body has a bell like hollow form with a lower widened contact mouth or border.

7 Claims, 2 Drawing Sheets

LEVELLING DEVICE FOR THE PLACING OF PIECES FOR COVERING FLOORS AND SIMILAR

SUBJECT OF THE INVENTION

The invention refers to a leveling device for placing pieces for covering floors and similar, that is, a leveling device especially adequate for the placing of adjacent ceramic pieces, panels or tiles correctly aligned and leveled.

BACKGROUND OF THE INVENTION

For the placing of flat covering pieces such as ceramic pieces, tiles and other similar with a substantially uniform thickness on the floor, walls or other substrates, a holding layer of mortar or adhesive is used on which the covering pieces are located. This operation requires a certain precision from the side of the operator in order that afterwards the surface which bears the covering pieces shows a smooth and sufficiently level finishing. This process is annoying and time consuming. Each of the pieces has to be placed, leveled and left flush with the adjacent pieces already placed, in an individual and completely artisanal form.

The process has to be carried out carefully as at the moment of the placing of the covering pieces the layer of mortar or adhesive being used is soft and although the receiving lower surface or substrate may be completely smooth, the covering pieces may be somewhat tilted and not level, with the result of a faulty finishing of the covering. The mortar permits as well to absorb the irregularities of the substrate to be covered, although to a very limited extent.

At present, the leveling of the covering pieces has to be carried out by means of the traditional system, that is, after having applied the mortar or adhesive on the substrate aimed at receiving the covering pieces, the first covering element is placed and by means of a hand leveling tool its position is controlled without other assistance or means. If the covering piece does not appear to be properly leveled, its position is corrected by hammering the same with a rubber beater. This job is to be carried out repeatly for all the pieces of the covering so that it is a hard and annoying job as the operator has to work in an uncomfortable position during the whole working time, this being especially true in case of floor coverings.

In the following some embodiments of devices used so far for the alignment of covering pieces will be described.

One example of a device of this type is disclosed in the patent document U.S. Pat. No. 4,397,125 for a "System for aligning uneven thickness panel sections" which permits to obtain wall, floor or ceiling surfaces with a well aligned finishing on a plane, starting from covering pieces which do not have identical thickness, describing a device with a back plate which has a hole in which a screw is directly secured or on a protruding wing, with latching means for said screw; a back pressure plate being located in the back portion of the device, being pushed against the back plate by a nut or a wing nut engaged on said screw, to retain the adjacent covering pieces or panels by its borders. This system suffers from the inconvenience that the threaded screw and nut parts may be soiled with the mortar or adhesive being therefore difficult its withdrawal later on. Furthermore the metal parts and the screw may force to permit very substantial separations for which reason the system is more adequate for the placing of stone pieces on a wall with substantial separations between one another than for the placing of thin pieces for covering a substrate.

It is also known that the U.S. Pat. No. 5,675,942 "Wall panel alignment device and spacer" describes a similar device which is comprised of a base plate with a blocking shaft, a blocking plate and a latching element to keep the front and back sides of a couple of panels with similar thickness located on a wall in sideways alignment, while the adhesive applied to the panels solidifies, providing a smooth front surface. The base plate includes a lateral surface to hold the pair of panels in a common lateral back plane. The latching means is incorporated in the blocking plate to be engaged in the shaft by means of complementary toothed means which keep said latching element blocked in its place in respect of the base plate in the assembly of panels. The system for the engagement between the latching element and the shaft, in the way of a toothed belt, may be easily and directly located, for instance by hand or by means of a tool like those used for fitting clamps. However, to ensure that the sufficient alignment pressure may be carried out, the teeth have substantial dimensions and the pitch separating them is also sizeable. This purports that the adjustment of the alignment can not be carried out with the sufficient precision in the advance movement and with the sufficient pressure, as the engagement between the blocking plate in a given tooth of the toothing may finally be somewhat loose and the gearing with the next tooth can not be obtained or the pressure may be excessive, this resulting in a faulty assembly.

US patent applications US2006/0185269 y US2006/185319 both for "Tile alignment and leveling device and method for using the same" describe a device for the alignment and leveling of tiles on floors, ceilings and other substrates, which device has an upper plate with multiple separating wings and a lower plate. Both plates are combined by means of a post or shaft which extends from the lower plate going trough the upper plate so that the upper plate is movable along said post. In its use the device is located between adjacent tiles so that the upper and lower plates hold the adjacent tiles at the desired height while the mortar or adhesive solidifies. For the securement of the upper plate on the post in an adequate position a metal insert is used for its sideways introduction, engaging in one of the multiple notches which have been made crosswise in said post, this not permitting to regulate the pressure in a progressive and precise way as said notches are substantially separate between each other, so they don not permit a progressive introduction.

DESCRIPTION OF THE INVENTION

The leveling device for placing covering pieces which is the subject of the invention has technical features aimed at facilitating the job of placing and aligning the covering pieces to obtain the leveling of the pieces on floors, ceilings, vertical and inclined walls, absorbing the irregularities of the substrate by means of the adhesive layer, as well as the geometrical irregularities of the covering pieces or the shrinking produced during the setting of the mortar or adhesive, which may generate undesired movements of the pieces already placed on the substrate. The device makes the annoying leveling operations easier, reducing the time used for the leveling of the covering pieces. Furthermore it directly permits the reduction of the assembly costs. This reduction of the working time reduces as well the strain on the operator for reducing the time during which he is submitted to inadequate postures, above all when carrying out the works on floors, walls or ceilings, improving the ergonomic conditions of work for the operator.

According to the invention, the flexible post has a rectangular cross section with two major sides which respectively have mutually opposed toothings, with teeth which are offset among each other and the passage in the second body has two latching pawls for holding said teeth which are parallel and mutually opposed. In this way, in an operative position of the device, the teeth of the flexible post engage in alternative form said pawls, obtaining a higher precision and control of the advance and the pressure exerted by said bodies on the aligned covering pieces, by permitting that during the advancement for the securement of the second body one side or the other of the flexible post is always engaged at a distance which is substantially shorter than in the case of using only one toothing. It has been foreseen as well that the second body has a bell like hollow form with a widened lower contact mouth or border to distribute the pressure on the pieces of the covering. This permits to obtain a higher rigidity of the second body than in the case of using flat parts, excluding the need of rigidifying metal inserts. Besides, the pressure action distributed by an external circle prevents the formation of high pressure points such as a raised corner of a covering piece or a particle of material introduced between said covering piece and the second covering piece, which would result in a faulty alignment.

The second body is optionally transparent, this contributing to a better control of the positioning of the device on the covering pieces to be aligned, especially in difficult corners and joints. However, it is not to be discarded that said second body may be of a non-transparent colour in less stringent applications.

The first body has curved perimetral borders opposed one another in form of thin and flexible flanges directed towards the same side of the flexible post. Said flexible flanges have at least one notch or recess in its intermediate part, separating independent support parts to rest on the independent covering pieces. These flexible flanges permit that the support of the covering piece may be well balanced independently that the contact point of the first body takes place on the back portion of the covering piece directly on its flat surface or on one of the recesses or protrusions which usually have to ensure the retention with the adhesive.

To facilitate the convenient introduction of the second or bell like body within the flexible post it has been provided that the free end of said flexible post has a tapering cross section. For instance, it may show an oblique or arrow like form, thus facilitating the entry of the second body and the tightening tool.

In one embodiment the weakened portion for the release of the flexible post is flush with the top side of the first body. In this manner when said flexible post is released, no protrusion of the first body remains on the opening of the covering pieces no matter of how thin these may be.

In one embodiment, the device has a cross like separation part in the form of a low height prismatic body showing an opening or slit for the passage of the flexible post. Said cross like separation piece, that in a top view may show an elongated, cross-wise form, in T form is operatively appropriate for the separation of the covering pieces located between the first and second bodies for its proper separation.

DESCRIPTION OF THE DRAWINGS

To complete this description and with the objective to facilitate the understanding of the features of the invention, a set of drawings is annexed to this description in which, in an illustrative non-limitating way, the following has been represented.

PREFERRED EMBODIMENT OF THE INVENTION

Figure 1:
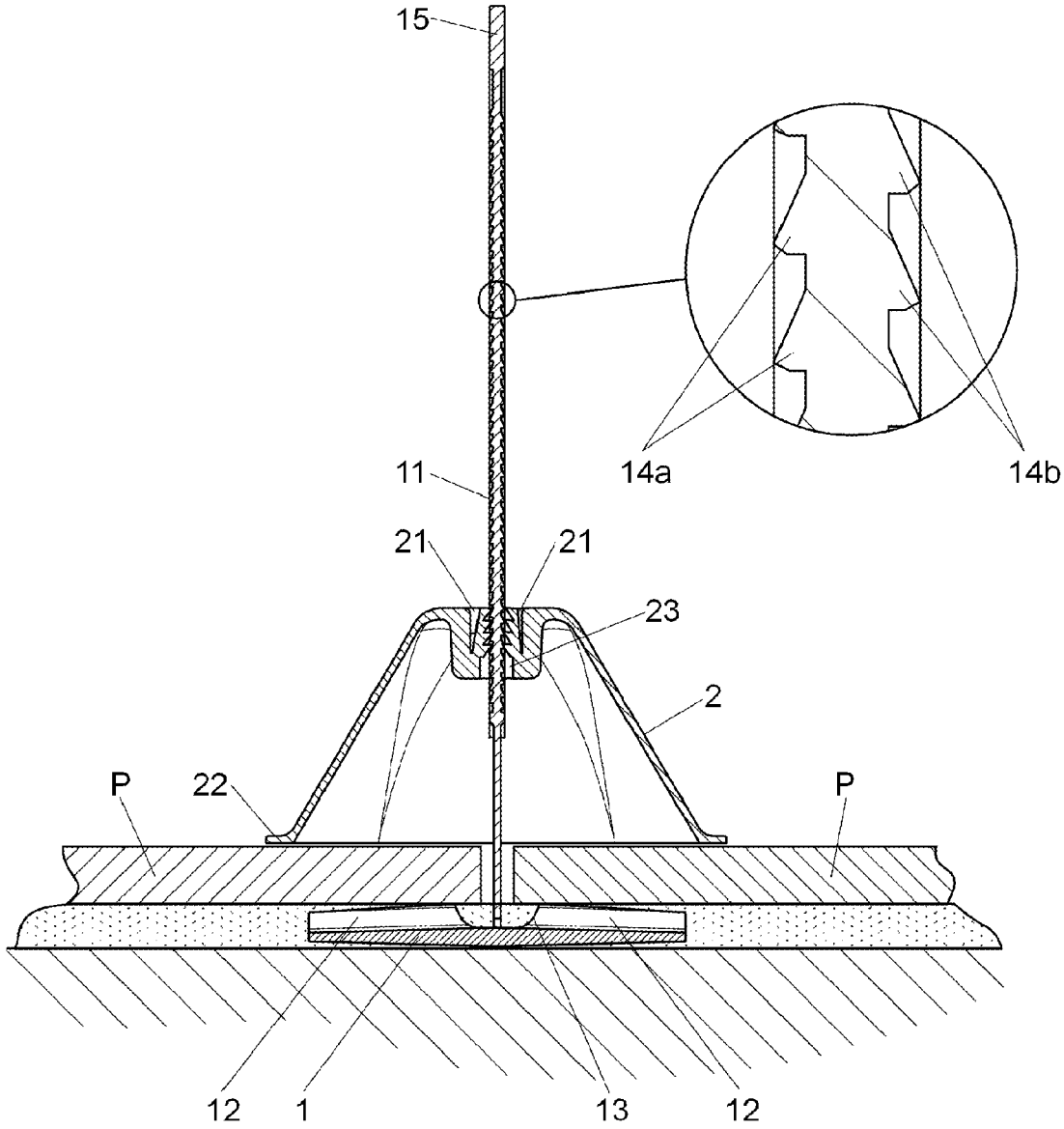
FIG. 1 shows a side view in cross section of an embodiment of the invention.

As to be seen in the drawings, the leveling device is comprised of a first lower body of plastic material (1) adopting a substantially flat form and having in its upper side a flexible post (11) which emerges perpendicularly and approximately from the central portion, on which post a second body (2) is arranged, for pressing the adjacent covering pieces (P) located between both bodies (1, 2).

The first lower body (1) has an approximately rectangular configuration, showing in two mutually opposed borders respective thin flexible flanges (12) both directed towards the side which has the flexible post (11). Each of said flanges (12) show in this case a cut-out (13) in its intermediate part which separates two side portions for the independent contact on respective adjacent covering pieces (P).

The flexible post (11) has a rectangular substantially flat cross section, showing in both main surfaces respective toothings with multiple teeth (14*a*, 14*b*) to receive respective retention latching pawls (21) of the second body (2). The teeth (14*a*) of one of the surfaces are half a pitch offset in respect of the teeth (14*b*) of the other surface. The free end (15) of the flexible post (11) shows a tapering cross section, in the present case of triangular shape in the form of an arrow-like point; said flexible post (11) being secured by its lower end to the first body (1) by means of a flush weakened portion (16).

The second body (2) has a bell like hollow form made out of a transparent plastic material with the mouth (22) open to the lower part and an upper passage (23) for the flexible post (11), said passage having in each of its sides one of the retention pawls (21) arranged in parallel form and opposed to each other.

Figure 2:
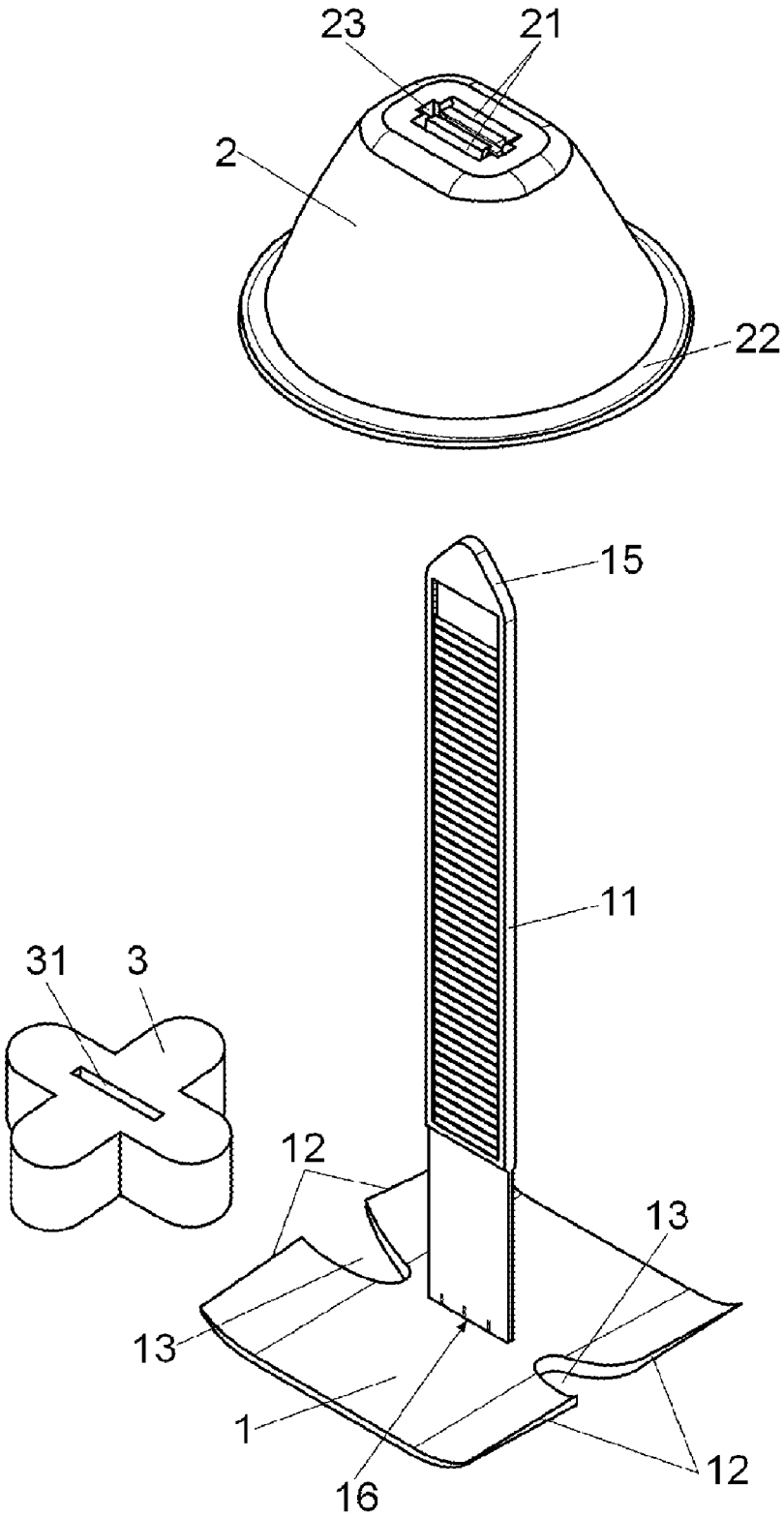
FIG. 2 shows a perspective exploded view of the device.

In an optional embodiment a separating part (3) has been provided which adopts the form of a prismatic body with a reduced height and a generally cross-like form. In this case it shows an opening or slit (31) for the passage of the flexible post (11) as shown in FIG. 2.

After having sufficiently described the nature of the invention as well as one preferable example of carrying out the same it is represented to all effects that the materials, shape, size and arrangement of the elements which have been described could be modified whenever said modifications do not represent an alteration of the essential characteristics of the invention which are claimed in the following.

The invention claimed is:

1. A leveling device for placing of flat pieces for covering surfaces, comprises:

a first lower substantially flat body configured for placement under the flat covering pieces, a flexible post emerging from an upper surface of said first lower substantially flat body perpendicular to the first lower substantially flat body and substantially centered on the first lower substantially flat body, such that the flexible post emerges between two of the flat covering pieces to be leveled by the leveling device; and a second upper body which has a passage configured for receiving and holding said flexible post until exerting a pressure against the flat covering pieces when it is brought close to the first lower substantially flat body, aligning said flat covering pieces;

the flexible post further comprising a portion configured to allow for its withdrawal, wherein the flexible post has a rectangular cross section with opposite main surfaces thereof further comprising a first set of teeth positioned on a first main surface and a second set of teeth positioned on a second main surface, wherein the first and second sets of teeth are offset in a lengthwise direction along a length of the flexible post with respect to each other; and wherein the passage of the second body includes two latching pawls opposed one another so that in an operative position of the device, the teeth of each of the two opposite first and second sets of teeth on the flexible post alternately engage with said pawls, permitting high precision control of the advancement movement and the pressure exerted by the first lower substantially flat body and the second upper body on the aligned covering pieces, and wherein the second upper body is bell shaped with a lower widened contact mouth or border configured to distribute pressure on the flat covering pieces.

2. The leveling device according to claim 1, wherein the second upper body is transparent.

3. The leveling device according to claim 1, wherein the first lower substantially flat body has curved, perimetral mutually opposite borders in the form of thin and flexible flanges directed towards the same side of the first lower substantially flat body in which the flexible post is located.

4. The leveling device according to claim 3, wherein each flexible flange has at least one opening or cut-out positioned in an intermediate part thereof to separate portions to independently bear on covering pieces.

5. The leveling device according to claim 1, wherein a free end of the flexible post has a tapering cross section.

6. The leveling device according to claim 1, wherein the portion of the flexible post configured to allow for its withdrawal is positioned flush with the upper surface of the first lower substantially flat body (1).

7. The leveling device according to claim l, further comprising:

a separating part with the configuration of a prismatic body with reduced height which has a slit for passage of the flexible post, said separating part configured for separating the covering pieces arranged between the first body and the second body for spacing said pieces relative to each other.

* * * * *